US006173927B1

(12) United States Patent
Delsol

(10) Patent No.: US 6,173,927 B1
(45) Date of Patent: Jan. 16, 2001

(54) DEVICE FOR SUSPENDING A HORIZONTAL HEAT-EXCHANGER TUBE FROM A VERTICAL SUPPORTING TUBE

(75) Inventor: Gilbert Delsol, Cernay la Ville (FR)

(73) Assignee: Alston France S.A., Paris (FR)

( * ) Notice: Under 35 U.S.C. 154(b), the term of this patent shall be extended for 0 days.

(21) Appl. No.: 09/334,607

(22) Filed: Jun. 17, 1999

(30) Foreign Application Priority Data

Jun. 18, 1998 (FR) ..... 98 07685

(51) Int. Cl.[7] ..... F16L 3/08

(52) U.S. Cl. ..... 248/74.1; 122/510; 122/511

(58) Field of Search ..... 248/74.1, 74.3, 248/73, 56, 62, 63, 68.1, 69, 61; 122/510, 511; 165/76, 82, 162

(56) References Cited

U.S. PATENT DOCUMENTS

| | | | | |
|---|---|---|---|---|
| 2,757,649 | * | 8/1956 | Coughlin | 122/478 |
| 2,923,279 | * | 2/1960 | Schmidli | 122/510 |
| 3,159,146 | * | 12/1964 | Rudolph | 122/510 |
| 3,164,137 | * | 1/1965 | Liessenberg | 122/510 |
| 3,265,044 | | 8/1966 | Juchtern | 122/510 |
| 3,896,771 | * | 7/1975 | Chayes et al. | 122/510 |
| 4,307,777 | * | 12/1981 | Chwyla | 165/76 |
| 4,512,336 | * | 4/1985 | Wiener | 126/442 |
| 4,747,373 | * | 5/1988 | Wepfer et al. | 122/510 |
| 4,944,254 | * | 7/1990 | Fournier et al. | 122/511 |
| 4,961,402 | * | 10/1990 | Delsol | 122/510 |
| 5,404,941 | * | 4/1995 | Jacksits | 165/162 |
| 5,943,985 | * | 8/1999 | Hartman | 122/511 |

FOREIGN PATENT DOCUMENTS

| | | | |
|---|---|---|---|
| 0 030 025 A3 | 6/1981 | (EP) . | |
| 0 364 920 A1 | 4/1990 | (EP) . | |
| 0 775 885 A1 | 5/1997 | (EP) . | |
| 2 741 706 A1 | 5/1997 | (FR) | F28F/9/26 |

* cited by examiner

*Primary Examiner*—Ramon O. Ramirez
*Assistant Examiner*—Tan Le
(74) *Attorney, Agent, or Firm*—Sughrue, Mion, Zinn, Macpeak & Seas, PLLC

(57) ABSTRACT

A device which suspends a horizontal heat-exchanger tube from a vertical supporting tube, including a flat section member adapted to be welded to an outside wall of the vertical supporting tube and parallel to an axis thereof, the flat section member being provided with a rounded notch which receives a support piece adapted to accommodate the horizontal tube, wherein the tube-receiving support piece is a folded metal sheet that is folded to match a shape of the notch and adapted to surround a portion of an outside periphery of the tube, the support piece having a top end and a bottom end, each of the ends being folded over towards the flat section member so as to be welded thereto, and wherein a collar adapted to enclose the horizontal tube is fixed against the tube-receiving support piece.

3 Claims, 1 Drawing Sheet

DEVICE FOR SUSPENDING A HORIZONTAL HEAT-EXCHANGER TUBE FROM A VERTICAL SUPPORTING TUBE

BACKGROUND OF THE INVENTION

Patent Document FR 2 741 706 describes such a device which comprises a section member welded along a generator line of the vertical supporting tube and a machined piece forming a cradle for the horizontal tube, the machined piece being welded to the horizontal tube and being fixed by dovetail assembly means to the section member welded to the vertical tube.

Such a device uses a molded supporting piece that is of complex shape and that can crack.

SUMMARY OF THE INVENTION

An object of the invention is to provide a suspension device that is simpler and that uses no complicated molded piece.

To this end, the invention provides a device for suspending a horizontal heat-exchanger tube from a vertical supporting tube, a flat section member being welded to the outside wall of the vertical supporting tube and parallel to the axis thereof, said flat section member being provided with a rounded notch for receiving a support piece for receiving said horizontal tube, wherein said tube-receiving support piece is a folded metal sheet that is folded to match the shape of said notch and to surround a portion of the outside periphery of the tube, and that has each of its ends, namely its top end and its bottom end, folded over towards said flat section member so as to be welded thereto, and wherein a collar enclosing the horizontal tube is fixed against said tube-receiving support piece.

Advantageously, each of said ends folded over towards said flat section member is provided with a cutout so that said ends embrace the flat section member and are welded thereto.

BRIEF DESCRIPTION OF THE DRAWINGS

An embodiment of the invention is described below with reference the accompanying drawing, in which.

DETAILED DESCRIPTION OF THE PREFERRED EMBODIMENTS

Figure 1:
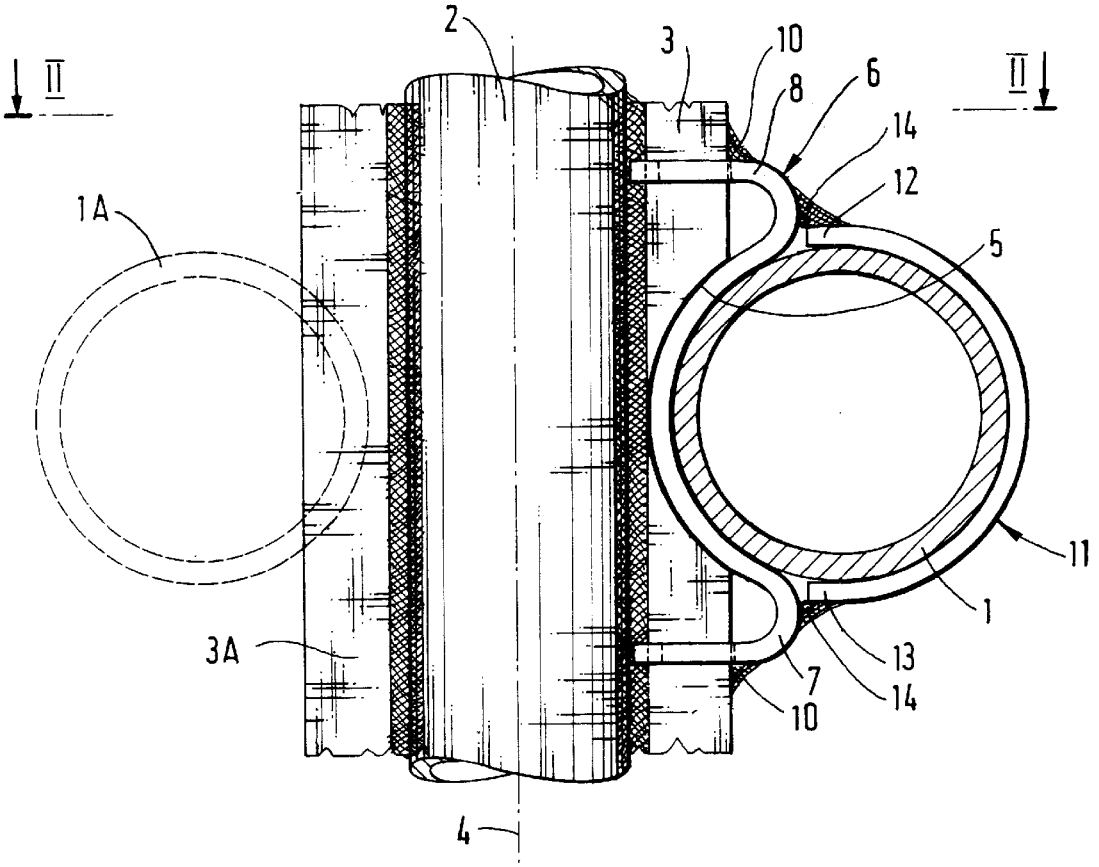
FIG. 1 is an elevation view of a device of the invention for suspending a horizontal heat-exchanger tube from a vertical supporting tube.
Figure 2:
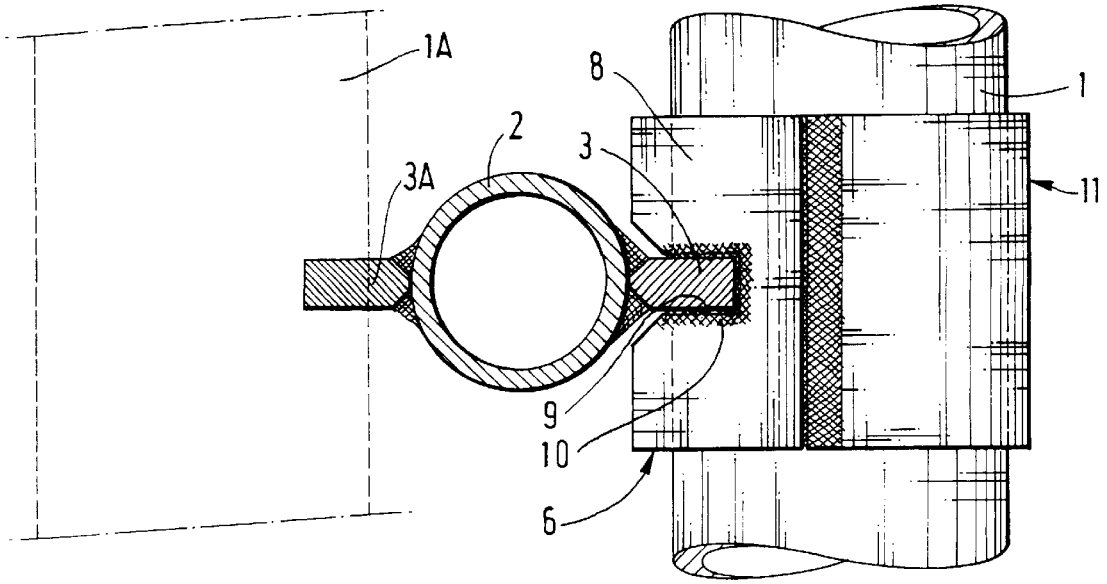
FIG. 2 is section view on II—II of FIG. 1.

The figures show a device of the invention for suspending a horizontal heat-exchanger tube 1 from a vertical supporting tube 2.

The tube 1 is part of a vertical bank of horizontal heat exchanger tubes such as 1 suspended from a plurality of vertical supporting tubes such as 2 connected to a fixed structure (not shown). A second bank of horizontal tubes 1A is also supported by the supporting tubes 2 facing the tubes 1. Only the device for suspending one tube (tube 1) is shown in the drawing.

The suspension device comprises a flat section member 3 welded to the outside of the tube 2 parallel to the axis 4 thereof. The section member 3 is used to suspend the entire bank of tubes such as 1 (for the tubes 1A, a section member 3A is also welded to the other side of the vertical tube 2).

Facing the tube 1, the section member 3 is provided with a rounded notch 5 for receiving a tube-receiving support piece which is constituted by a single folded metal sheet 6 whose outside face matches the shape of the rounded notch 5 and whose inside face surrounds a portion of the outside periphery of the tube 1. The ends 7 and 8 of the metal sheet are folded over towards the flat section member 3, and each of them is provided with a cutout 9 so as to embrace the flat section member 3 to which each end is welded at 10.

Finally, a collar 11 also made of a single folded metal sheet encloses the tube 1, and its ends 12 and 13 are welded to the folded metal sheet 6. A metal washer 14 fills the gap between the ends of the collar 11 and the folded metal sheet 6 on welding.

The post-welding shrinkage clamps the tube 1 between the two half shells formed by the pieces 6 and 11. The tube 1 is thus firmly held.

Thus, the suspension device of the invention is very simple and cheap because it comprises rolled and notched pieces only.

What is claimed is:

1. A device which suspends a horizontal heat-exchanger tube from a vertical supporting tube, said device comprising:

a flat section member adapted to be welded to an outside wall of the vertical supporting tube and parallel to an axis thereof, said flat section member being provided with a rounded notch which receives a support piece adapted to accommodate said horizontal tube, wherein said tube-receiving support piece is a folded metal sheet that is folded to match a shape of said notch and adapted to surround a portion of an outside periphery of the tube, said support piece having a top end and a bottom end, each of said ends being folded over towards said flat section member so as to be welded thereto, and wherein a collar adapted to enclose the horizontal tube is fixed against said tube-receiving support piece.

2. A device according to claim 1, wherein each of said ends folded over towards said flat section member is provided with a cutout so that said ends embrace said flat section member and are welded thereto.

3. A device according to claim 1, wherein said collar adapted to enclose the horizontal tube is welded against said tube-receiving support piece.

* * * * *